US005253720A

United States Patent [19]

Radford et al.

[11] Patent Number: 5,253,720

[45] Date of Patent: Oct. 19, 1993

[54] METHOD AND APPARATUS FOR TAKING AN UNDISTURBED CORE SAMPLE

[75] Inventors: Steven R. Radford, South Jordan, Utah; Haraldur Karlsson, Kingwood, Tex.; James T. Aumann, Salt Lake City, Utah

[73] Assignee: Energy Ventures, Inc.

[21] Appl. No.: 716,664

[22] Filed: Jun. 13, 1991

[51] Int. Cl.[5] ..... E21B 25/00

[52] U.S. Cl. ..... 175/58; 175/250

[58] Field of Search ..... 175/20, 58, 239, 240, 175/244, 245, 249, 250, 251

[56] References Cited

U.S. PATENT DOCUMENTS

| | | | |
|---|---|---|---|
| 1,784,886 | 12/1930 | Baker . | |
| 1,853,581 | 4/1932 | Schmissrauter et al. | 175/58 |
| 1,954,777 | 4/1934 | Garfield | 175/245 |
| 2,141,261 | 12/1938 | Clark . | |
| 2,170,716 | 8/1939 | Higgins . | |
| 2,382,992 | 8/1945 | Harris . | |
| 3,064,742 | 11/1962 | Bridwell | 175/226 |
| 3,139,147 | 6/1964 | Hays | 175/233 |
| 3,146,837 | 9/1964 | Bridwell | 175/59 |
| 3,163,241 | 12/1964 | Daigle | 175/237 |
| 3,438,452 | 4/1969 | Bernard | 175/6 |
| 3,740,477 | 4/1956 | Monaghan | 166/63 |
| 3,794,127 | 2/1974 | Davis | 175/58 |
| 4,081,040 | 3/1978 | Henson | 175/58 |
| 4,256,192 | 3/1981 | Aumann | 175/233 |
| 4,310,057 | 1/1982 | Brame | 175/21 |
| 4,335,622 | 6/1982 | Bartz | 73/864.74 |
| 4,350,005 | 9/1982 | Thompson | 73/864.74 |
| 4,356,873 | 11/1982 | Hyland | 175/58 |
| 4,518,050 | 5/1985 | Sollie | 75/250 |
| 4,552,229 | 11/1985 | Radford et al. | 175/240 |
| 4,553,613 | 11/1985 | Radford | 175/250 |
| 4,605,075 | 8/1986 | Radford et al. | 175/58 |
| 4,606,416 | 8/1986 | Knighton et al. | 175/58 |
| 4,607,710 | 8/1986 | Radford | 175/249 |
| 4,669,554 | 6/1987 | Cordry | 175/59 |
| 4,804,050 | 2/1989 | Kerfoot | 175/20 |
| 4,807,707 | 2/1989 | Handley | 175/20 |

FOREIGN PATENT DOCUMENTS

| | | | |
|---|---|---|---|
| 33793 | 3/1977 | Japan | 175/58 |
| 174164 | 1/1961 | Sweden | 175/244 |

OTHER PUBLICATIONS

SPE 15385 "Improved Coring . . . " Whiteby, 1986.
SPE 14297 "New Technology . . . ", Tibbit s, 1985.

*Primary Examiner*—David J. Bagnell
*Attorney, Agent, or Firm*—Fulbright & Jaworski

[57] ABSTRACT

The invention is a coring device which has features to seal off from the well fluids prior to taking of the specimen. The apparatus can be hydraulically or pneumatically actuated to move an inner string which is connected to a core barrel. Prior to moving the core barrel, an outer tube is sealingly pushed into the formation. Once the outer tube has been set into the formation, the inner tube drives the core barrel into the formation, leaving behind a rabbit. A clam shell is located at the forward end which stays open as the core barrel is driven into the formation and closes as the core barrel is withdrawn into the outer tube to retain the core. The pneumatic or hydraulic pressure continues to be applied to the inner string as the core barrel is withdrawn into the outer tube. Upon full retraction of the core barrel into the outer tube, a ball valve is actuated to seal off the core barrel. At that time, the hydraulic or pneumatic pressure is removed and the apparatus is pulled to the surface. The core barrel has a venting feature to allow any gas in the core barrel to escape as the core barrel fills with the core sample.

19 Claims, 4 Drawing Sheets

METHOD AND APPARATUS FOR TAKING AN UNDISTURBED CORE SAMPLE

FIELD OF THE INVENTION

This invention relates to coring devices, specifically those which can take an undisturbed core sample. The device has particular applications to the environmental field, but may be useful in other contexts where there is a need to obtain an undisturbed sample.

BACKGROUND OF THE INVENTION

Coring devices have been in use for many years to obtain specimens, either at the surface or in a subterranean well. Typical of such devices are U.S. Pat. Nos. 4,356,872; 4,518,050; 3,794,127; 4,081,040; 3,438,452; 3,064,742; 3,146,837; 2,170,716; 1,784,886; 3,139,147; 4,807,707; 2,382,992; 4,669,554; 4,310,057; 2,141,261; 4,350,051; 4,335,622; 4,804,050; and 2,740,477.

Some of these devices have incorporated a ball valve at the lower end to close off the core barrel after a sample is obtained. This feature is shown in U.S. Pat. Nos. 3,146,837; and 4,356,872. These ball valves are mounted in the tool, with the core barrel typically extending through the ball valve when the valve is in the open position to obtain the core specimen. Once the sample has been obtained and the core barrel is retracted, upon return of the core barrel into the tool, a linkage device has been employed to close off the ball valve to isolate the core barrel within the tool. This feature is also shown in U.S. Pat. No. 4,256,192, as well as in Eastman Christensen Technical Data Sheet entitled "Pressure Coring Service."

In the past, devices resembling a clam shell, referred to as full closure core catchers, have been used at the lower end of the core barrel to recover loose, soft or unconsolidated formations practically and efficiently. The core catchers are spring-loaded devices which are also helpful in gripping more consolidated formations securely and retaining them in the core barrel. Typical patents illustrating this feature are U.S. Pat. Nos. 4,606,416; 4,552,229; 4,553,613; 4,607,710; and 4,605,075; and Society of Petroleum Engineers (SPE) paper SPE-15385, entitled "Improved Coring and Core-Handling Procedures for the Unconsolidated Sands of the Green Canyon Area, Gulf of Mexico," by L. E. Whitebay of Conoco, Inc., presented at the 61st Annual Technical Conference and Exhibition of the Society of Petroleum Engineers held in New Orleans, La., Oct. 5-8, 1986.

Also generally of interest to the field of core sample taking are U.S. Pat. No. 3,163,241 and SPE paper 14297 entitled "New Technology in Tools for Recovery of Representative Cores from Uncemented Sand Formations," by G. A. Tibbitts, Drilling Research Laboratory, and S. R. Radford, then with Norton Christensen Inc. and an inventor of this apparatus. This paper was delivered at the 60th Annual Technical Conference and Exhibition of SPE held in Las Vegas, Nev., Sep. 22-25, 1985.

While there have been many different designs of coring devices available in the past, they have not addressed the issue of taking an undisturbed specimen from a formation which is not contaminated by the well fluids. The apparatus of the present invention has unique characteristics to allow it to obtain such undisturbed specimens.

SUMMARY OF THE INVENTION

The invention is a coring device which has features to seal off from the well fluids prior to taking of the specimen. The apparatus can be hydraulically or pneumatically actuated to move an inner string which is connected to a core barrel. Prior to moving the core barrel, an outer tube is sealingly pushed into the formation. Once the outer tube has been set into the formation, the inner tube drives the core barrel into the formation, leaving behind a rabbit. A clam shell is located at the forward end which stays open as the core barrel is driven into the formation and closes as the core barrel is withdrawn into the outer tube to retain the core. The pneumatic or hydraulic pressure continues to be applied to the inner string as the core barrel is withdrawn into the outer tube. Upon full retraction of the core barrel into the outer tube, a ball valve is actuated to seal off the core barrel. At that time, the hydraulic or pneumatic pressure is removed and the apparatus is pulled to the surface. The core barrel has a venting feature to allow any gas in the core barrel to escape as the core barrel fills with the core sample.

DETAILED DESCRIPTION OF THE PREFERRED EMBODIMENT

Figure 1A:
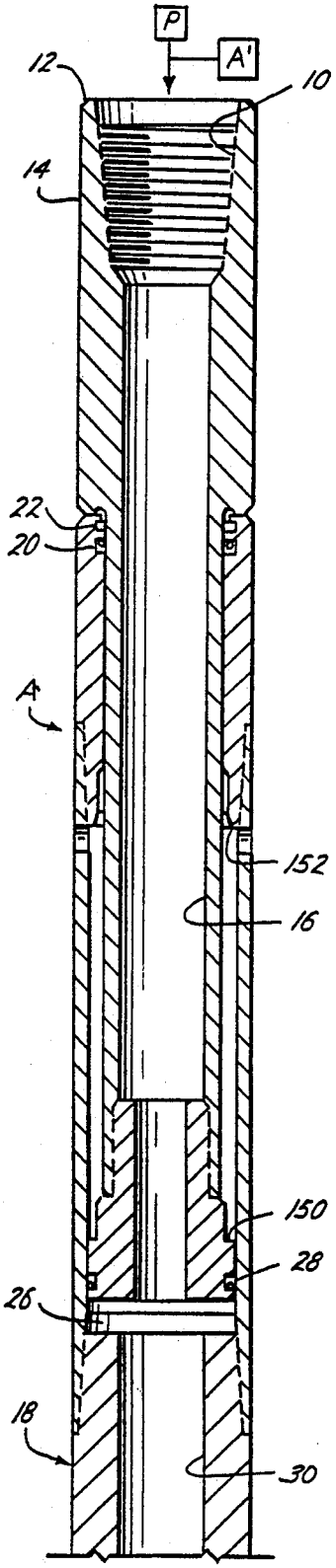
FIGS. 1(A-C) are a sectional view of the apparatus of the present invention in the run-in position.
Figure 1B:
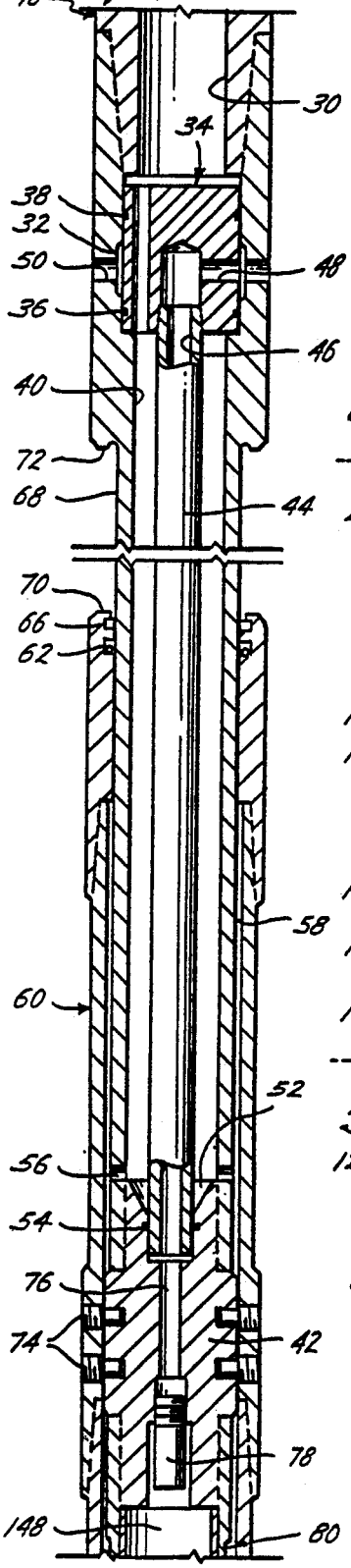
Figure 1C:
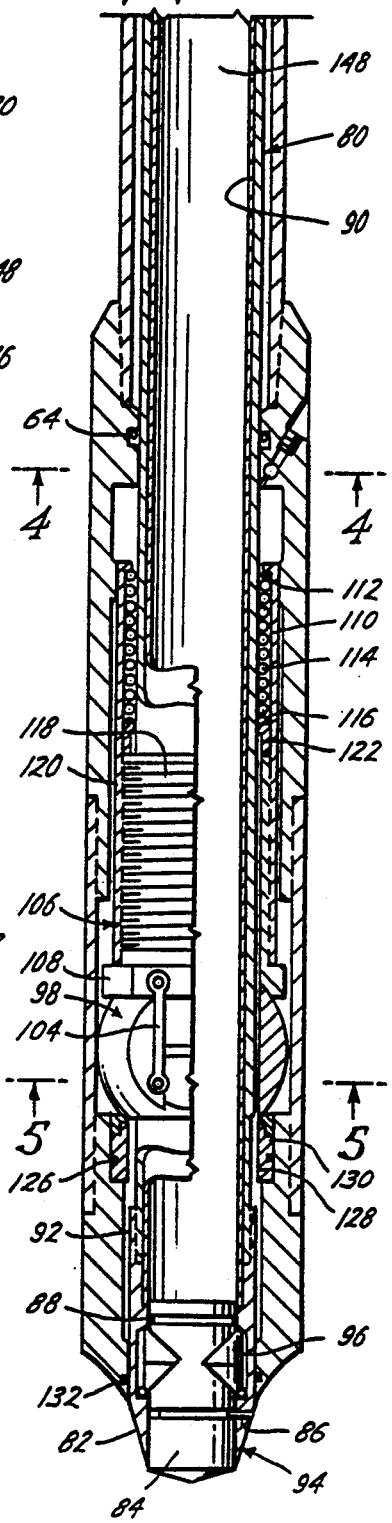
Figure 2A:
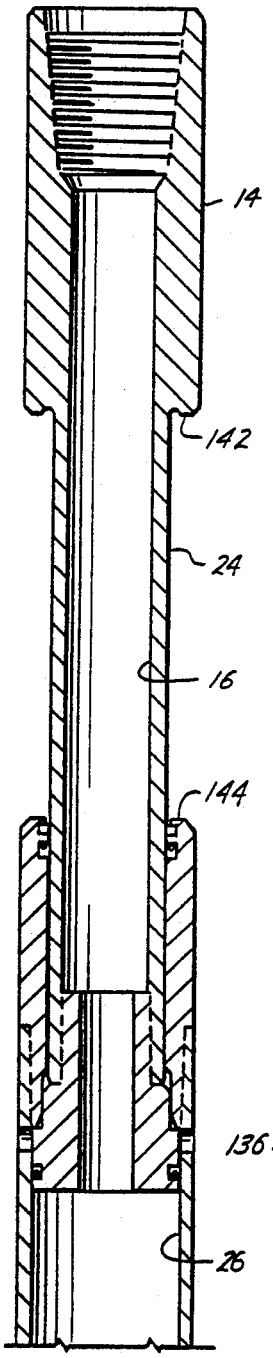
FIGS. 2(A-D) are the apparatus shown in FIGS. 1(A-C) during the insertion of the core barrel into the formation.
Figure 2B:
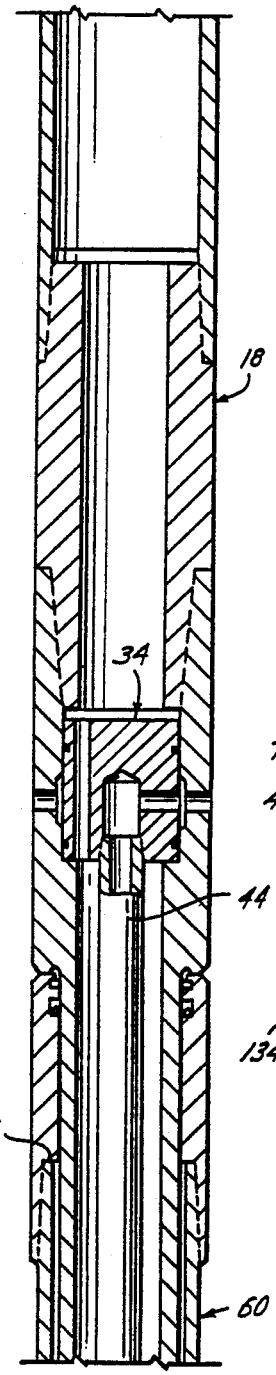
Figure 2C:
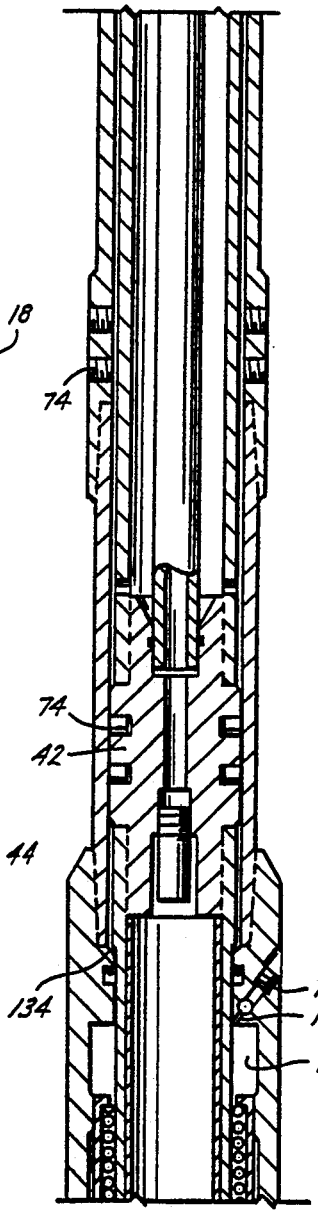
Figure 2D:
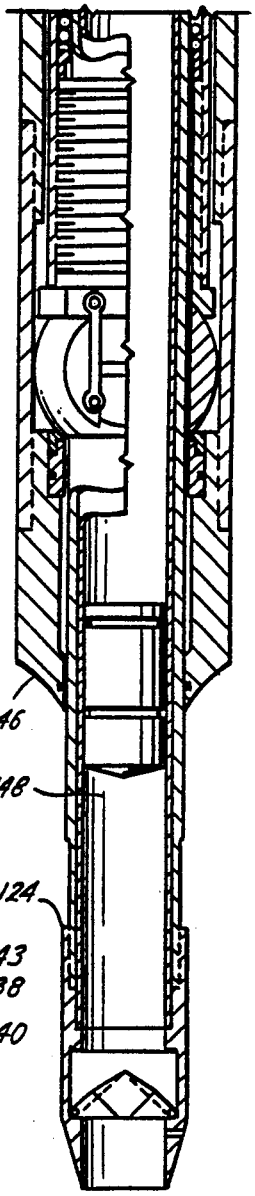
Figure 3A:
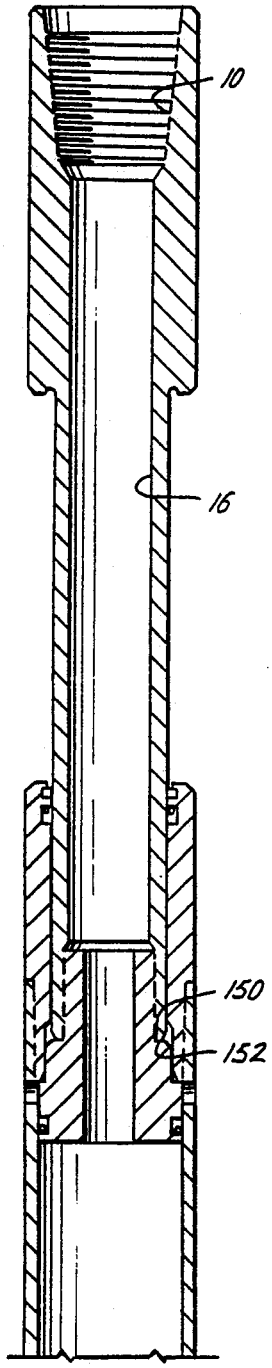
FIGS. 3(A-D) show the core barrel retrieved into the outer tube, with the tool in the position of retrieval from the wellbore.
Figure 3B:
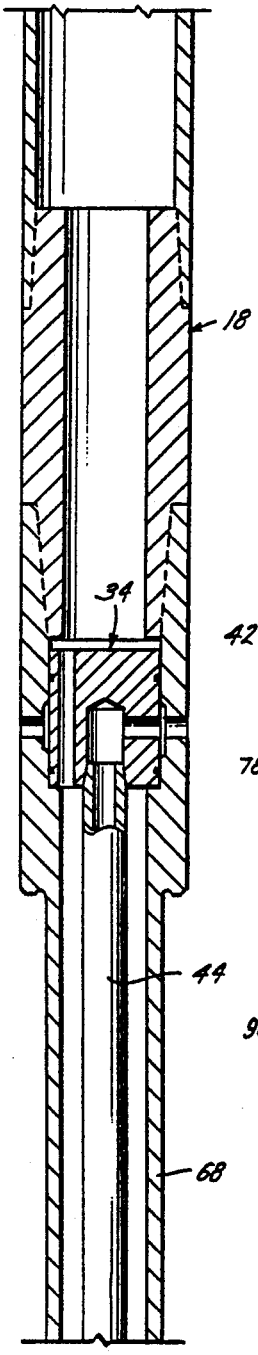
Figure 3C:
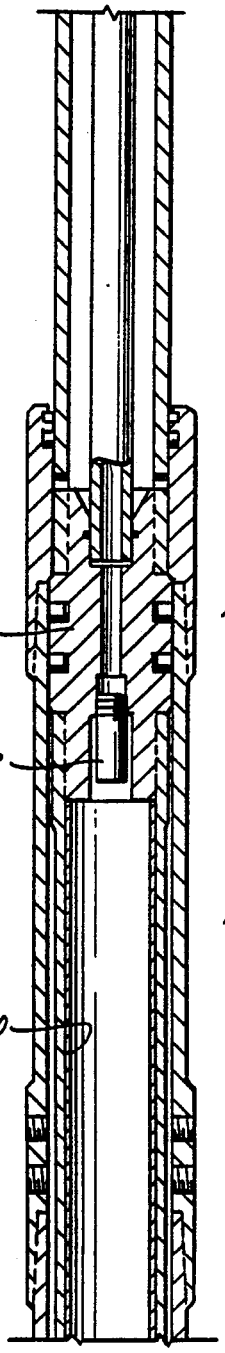
Figure 3D:
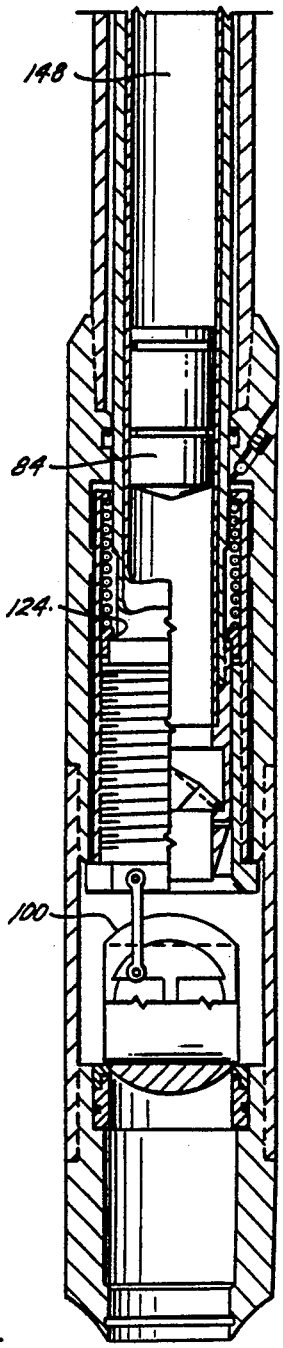

The apparatus A of the present invention is shown in the run-in position in FIGS. 1(A-C). A connection 10 is located at upper end 12 of the slip joint 14. A tubing string (not shown) is connected to connection 10 to facilitate the lowering of the apparatus A into a wellbore to obtain an undisturbed core sample. A pressure source P with an accumulator A' is used to actuate the apparatus. Other means of actuating the apparatus A are also within the scope of the invention.

Slip joint 14 has an internal passage 16 extending therethrough. Inner tube 18 is slidably mounted over slip joint 14, as seen by comparing the position of inner tube 18 in FIGS. 1(A-C) and 2(A-D). Toward the upper end of inner tube 18 is seal 20 to provide a sealing engagement between inner tube 18 and slip joint 14 as inner tube 18 translates with respect to slip joint 14. A wiper 22 is also mounted to inner tube 18 adjacent seal 20 to facilitate the sealing functions of seal 20. Those skilled in the art can appreciate that when the tool goes into the position as shown in FIGS. 2(A-D), the drilling fluids that are in the wellbore and the formation fluids that may also be in the wellbore will come in contact with surface 24. Accordingly, wiper 22 removes any accumulations of well fluids or drilling mud from surface 24 prior to contact of seal 20 with surface 24. Inner tube 18 is an elongated tubular member that has an upper passage 26, which is in flow communication with passage 16 of slip joint 14. In the run-in position as shown in FIGS. 1(A–C), slip joint 14 has a lower seal 28. The seal 28 isolates portions of passage 26 from passage 16 disposed between seal 28 and seal 20. Further down the tool, as indicated in FIGS. 1(A–C) and 2(A–D), passage 26 extends into passage 30. Passage 30 is then in fluid communication with passage 32, which extends through cross-flow block 34. A pair of seals 36 and 38 seal between cross-flow block 34 and passage 40. Passage 40 is in fluid communication with passage 32 and from cross-flow block 34 to piston 42 has an annular shape around vent tube 44. The purpose of vent tube 44 will be described below in the discussion of how a core is taken. At this point, those skilled in the art can appreciate that flow in passage 46 can enter cross-flow block 34 and exit the apparatus through aligned passages 48 and 50. Passage 48 is in cross-flow block 34 while passage 50 is in inner tube 18. During the operation of the tool, the relative position of cross-flow block 34 with respect to inner tube 18 remains unchanged, leaving passages 48 and 50 in constant alignment.

Piston 42 has a tapered upper surface 52. Vent tube 44 is sealed into piston 42 via seal 54. As passage 40 extends downwardly toward tapered surface 52, it branches laterally through openings 56 in inner tube 18. An annular space 58 is defined between outer tube 60 and inner tube 18 and extends from the upper end at a location adjacent seal 62 to its lowermost portion at seal 64. Wiper 66 is mounted adjacent seal 62 to wipe off any well fluids or drilling mud from surface 68 prior to seal 62 making contact with surface 68. Outer tube 60 has an upper shoulder 70 which can selectively come in contact with shoulder 72 on inner tube 18 for purposes of further driving outer tube 60 into the formation to be cored, as will be explained below.

A plurality of shear pins 74 retain piston 42 in the position shown in FIG. 1 until sufficient pressure is built up from the surface through passages 16, 30, 32, 40, and annulus 58 to shear pin 74 and allow piston 42 to start moving downwardly as shown in FIGS. 2(A–D).

Located within piston 42 is passage 76, which is in fluid communication with passages 46, 48, and 50 to provide a vent path out of the tool for any accumulated vapors during coring, as will be described below. Also located in passage 76 is check valve 78. Check valve 78 is of standard construction and is known to those skilled in the art. The preferred embodiment includes a check valve which is a spring-loaded ball. Passage 76 connects to the lower end of inner tube 18 which comprises the core barrel 80. At the lower end of core barrel 80 is a tapered section 82 to facilitate driving the core barrel 80 into the formation. Also at the lower end of core barrel 80 is a rabbit 84, which is initially held to core barrel 80 by shear pin 86. While the rabbit 84 is in the position shown in FIGS. 1(A–C), it extends slightly beyond tapered surface 82. A peripheral seals between the rabbit 84 and the core barrel 80. The core barrel 80 can be equipped with a liner 90 which can be removably mounted. The lower end 94 of core barrel 80, which contains taper 82, is threadedly connected at threads 92 to the remainder of the core barrel. As will be later described, when the core is pulled to the surface, it can be removed from the core barrel 80 by unthreading threads 92 to remove the lower end 94 of core barrel 80. When the lower end 94 is removed, the liner 90 is removed with it. Thereafter, a new liner 90 can be inserted and the process repeated.

Also mounted to lower end 94 is a clam shell 96, shown in FIGS. 1(A–C) in the open position, circumscribing rabbit 84, and shown in FIG. 2 in the closed position as the specimen in the core barrel 80 is returned to within outer tube 60.

Figure 5:
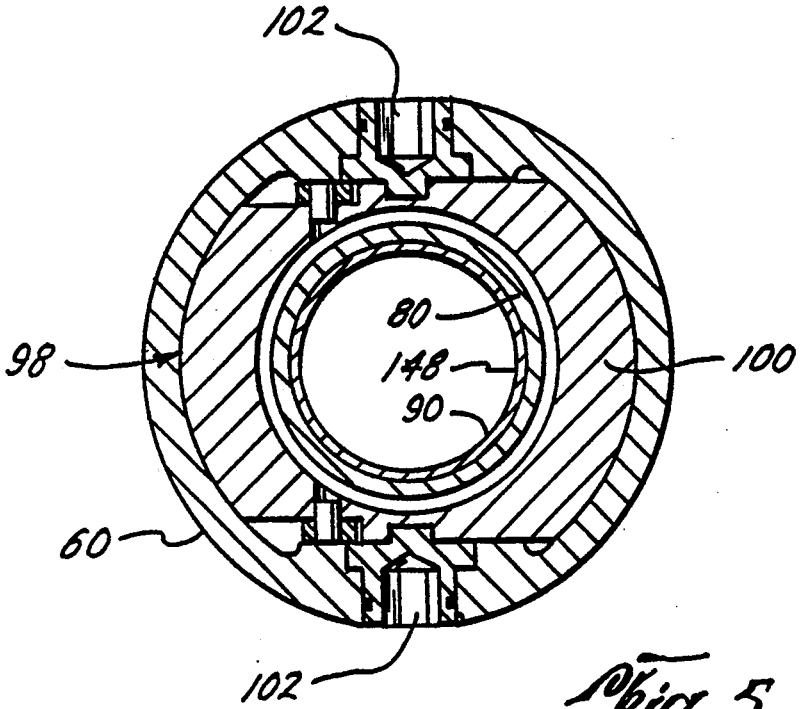
FIG. 5 is a sectional view taken at the line 5—5 in FIG. 1.

As shown in FIGS. 1(A–C), a ball valve assembly, generally referred to as 98, is included in the apparatus A. In the run-in position, the core barrel 80 extends through the ball valve assembly 98, which is then in the open position (see FIG. 5). As shown in FIG. 5, ball valve assembly 98 comprises of a ball 100, which is retained by pins 102. A link 104 is connected to ball 100 to actuate it upon movement of operator assembly 106. Operator assembly 106 comprises of a ring 108 connected to link 104. Connected to ring 108 is an elongated tubular member 110 terminating in an inwardly oriented shoulder 112. A spring 114 bears on shoulder 112 as well as ring 116. A second elongated tubular member 118 is threadedly connected to member 110 at threads 120. Ring 116 has an inwardly oriented shoulder 122 which catches a shoulder 124, as shown in FIG. 3. The engagement between shoulders 122 and 124 lifts ring 116 away from elongated member 118 and ultimately pulls up elongated member 110, which in turn pulls up ring 108 and link 104, turning ball 100 from the position shown in FIGS. 1(A–C) to the position shown in FIG. 3 after the core barrel 80 clears the ball 100 (see FIGS. 3(A–D).

The ball 100 rides against a seat 126 for sealing to the outer tube 60. The seat 126 is held in place by retainer 128 which is sealed against the outer tube 60 by seal 130.

Located near the lowermost end of outer tube 60 is seal 132, which prevents entry of formation fluids or drilling fluids into outer tube 60 as it is run into the formation before a core is taken.

It should be noted that the cross-sectional area of tapered surface 134, located adjacent seal 64, is greater than the cross-sectional area of tapered surface 136 so that when fluid pressure is exerted in annulus 58 there exists a net downward pressure applied on outer tube 60 to help retain outer tube 60 lodged in the formation during coring.

As shown in FIGS. 2(A–D) and 4, a vent passage 138 communicates with annular passage 140, wherein is housed operator assembly 106. Also located in passage 138 is a bleed valve 143, which can be used at the surface after coring to vent any accumulated fluid pressure in passage 140 prior to disassembly of the tool.

Looking now at the upper end of the tool, it can be seen that slip joint 14 has a shoulder 142, which can be brought into selective contact with shoulder 144 to selectively further drive the inner tube 18 as desired when taking a core. The various parts of the apparatus A now having been described, its operation will be described in detail. The apparatus A is connected to a tubing string and lowered to the desired depth in the wellbore adjacent the formation that is to be cored. Pumping facilities such as pump P are provided at the surface to raise the pressure in the tubing string and through passages 16, 30, 32, 40, 56, and 58. Accumulator facilities A' are also provided at the surface. Those skilled in the art will appreciate that accumulators of the bladder type, including a gas pocket above the bladder, can be useful in storing potential energy and converting potential energy to kinetic energy at a desired moment. The reason the accumulators are used with the apparatus of the present invention is to assist in the transfer of potential energy to kinetic energy at the piston 42 to assist the piston 42 to fully stroke.

All the components of the apparatus A of the present invention having been described, its operation will now be reviewed in detail. FIG. 1(A-C) indicate the position of the apparatus A as it is being run into the wellbore. The assembly is lowered until tapered surface 82 contacts the formation. Further letting up on the drillstring results in penetration of the formation by tapered surface 146. Seal 88 prevents migration of formation fluids or drilling mud past rabbit 84 into the inside 148 of core barrel 80. Once the outer tube 60 is sufficiently embedded into the formation in the position shown in FIGS. 1(A-C), pressure at the surface is increased to build up pressure through a flowpath comprising passages 16, 30, 32, 40, 56, and 58. Upon build-up of sufficient pressure on tapered surface 52 of piston 42, shear pins 74 are all sheared. Since rabbit 84 is butted up against the formation sufficiently into the formation to isolate well fluids from entering within the core barrel, as indicated by numeral 148, the shearing of pins 74 sends piston 42 in motion. Piston 42 is accelerated in part due to the sudden shearing of screws 74, plus the effect of the accumulated energy in the accumulator A' at the surface. As piston 42 accelerates, it moves in conjunction with vent tube 44 and cross-flow block 34 as the entire inner tube 18 moves downwardly. After initial movement of the core barrel 80, shear pin 86 is sheared, leaving the rabbit 84 up against the formation. As the core barrel 80 moves further into the formation as a result of the pressure acting on piston 42, the clam shell 96 clears rabbit 84 which is held stationary up against the formation. Upon full extension of core barrel 80, the process of retaining the sample obtained begins, and reference is required to FIGS. 2(A-D). It should be noted that during the time that the core barrel is driven into the formation, ball valve assembly 98 is in the open position, as shown in FIGS. 1(A-C). It should also be noted that by embedding the outer tube 60 sufficiently into the formation and further by provision of seal 132 and seal 88, the well fluids are isolated from chambers 148 and 140. By the time movement of the core barrel 80 occurs, there's been sufficient embedment of the outer tube 60 into the formation to isolate the apparatus A from well fluids. As the core barrel 80 is driven into the formation, the volume of chamber 148 between check valve 78 and rabbit 84 decreases. To allow any vapors accumulated in chamber 148 to escape, the check valve 78 is operable to relieve pressure in chamber 148 through tube 44 and out of the apparatus A through aligned passages 48 and 50.

As previously stated, the difference in cross-sectional areas between tapered surfaces 134 and 136 (see FIGS. 2(A-D) provides for a net downward force on outer tube 60 when pressure is applied into passage 40. This feature helps to retain outer tube 60 within the formation as core barrel 80 is driven into the formation past rabbit 84. If for any reason core barrel 80 has not sufficiently embedded itself in the formation, the operator at the surface can let up on the drillstring (not shown) thereby lowering slip joint 14 with respect to inner tube 18 until shoulder 142 hits against shoulder 144. In this manner, by repeatedly pulling up and letting off at the surface on the drillstring, the inner tube 18 to which the core barrel 80 is connected can be further driven into the formation.

It is now desired to retrieve the sample obtained and reference is made to FIGS. 2(A-D) and 3(A-D). To retrieve the sample, the operator at the surface pulls up on the drillstring, which in turn, due to the connection of the drillstring to slip joint 14, exerts an upward pull on slip joint 14 until shoulder 150 hits surface 152 (see FIGS. 3(A-D). Thereafter, as slip joint 14 is pulled up (see FIGS. 2(A-D), core barrel 80 is pulled back into outer tube 60. As the core barrel 80 moves back into outer tube 60, the motion in this direction causes clam shell 96 to pivot to the closed position shown in FIGS. 2(A-D). This retains loose or unconsolidated specimens obtained in chamber 148 from falling out. As the core barrel 80 moves further into outer tube 60 and clears ball 100, shoulder 124 hits against shoulder 122. This puts an upward force on ring 116, which pushes spring 114 upwardly, which in turn puts an upward force on elongated tubular member 110 which is connected to ring 108, which is in turn connected to link 104. As a result of the movements of the members just described, ring 108 is lifted upwardly. Since link 104 is connected offcenter to ball 100, a rotational motion results to ball 100, putting it in the position shown in FIGS. 3(A-D). While all this is going on, pressure from the surface continues to be applied through passages 16, 30, 32, 40, 56, and 58. Once the ball 100 is put in the closed position as shown in FIG. 3, the pressure applied at the surface is removed. At that time the apparatus is in the position shown in FIGS. 3(A-D), with the core barrel 80 completely within the outer tube 60 and valve assembly 98 in the closed position. Similarly, the clam shell 96 is also in the closed position to retain the core sample just obtained within chamber 148. Thus, before the outer tube 60 is extracted from the formation, the chamber 148 is isolated from any migration of well fluids or formation fluids into chamber 148.

Figure 4:
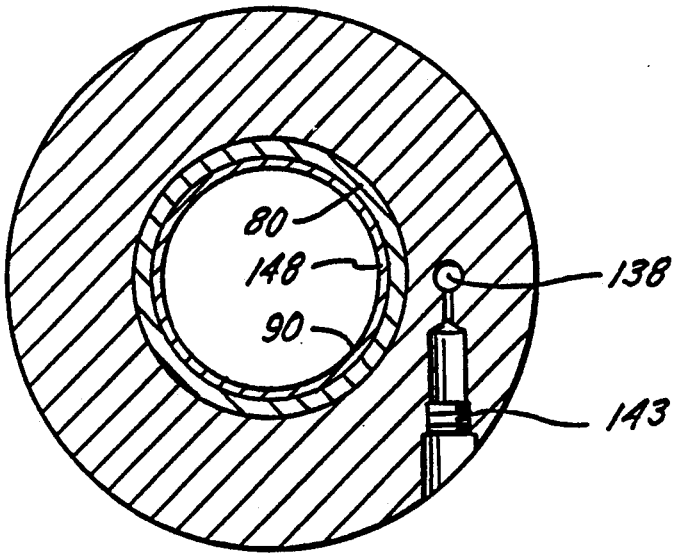
FIG. 4 is a sectional view taken at the line 4—4 in FIG. 1.

Thereafter, further upward pulling on the tubing string with shoulder 150 up against surface 152 results in removal of outer tube 60 from the formation. The tubing string is retrieved to the surface in the usual manner and the apparatus A is disconnected when it is brought to the surface. Any accumulated pressure in chamber 140 can be vented through the use of valve 143, as shown in FIG. 4. When the apparatus A is at the surface, pivot pin 102 is rotated to open ball 100. Downward force puts shoulder 144 into contact with shoulder 142, and continuing downward force pushes inner tube 80 through ball 100. Threads 92 are then undone, allowing removal of lower end 94. This exposes liner 90 (if used), for removal, thus allowing the core to then be cut up or otherwise subjected to any analysis or test.

The foregoing disclosure and description of the invention are illustrative and explanatory thereof, and various changes in the size, shape and materials, as well as in the details of the illustrated construction, may be made without departing from the spirit of the invention.

We claim:

1. A formation core sampling apparatus for a subterranean well where fluids are found, comprising:

a housing;

core barrel means selectively movable with respect to said housing by fluid pressure, from a retracted position to facilitate placement of an end of said housing into the formation to an extended position for obtaining a formation specimen in said core barrel;

sealing means releasably mounted to said core barrel means for isolating the fluids in the well from said core barrel means as said core barrel means is selectively moved into the formation, in its movement from said retracted to said extended position.

2. The apparatus of claim 1, wherein said sealing means further comprises:

plug means releasably affixed to said core barrel means at an end thereof;

a seal between said plug means and said core barrel means; wherein:

said core barrel means is releasably affixed to said housing; and said housing, core barrel means, and said plug means can be moved into the formation in tandem a sufficient depth to isolate said core barrel means from the well fluids.

3. A formation core sampling apparatus for a subterranean well where fluids are found, comprising:

a housing;

core barrel means selectively affixed to said housing and selectively movable with respect to said housing from a retracted position to facilitate placement of an end of said housing into the formation to an extended position for obtaining a formation specimen in said core barrel;

plug means selectively affixed to said core barrel means at an end thereof for isolating the fluids in the well from said core barrel means as said core barrel means is selectively moved into the formation, in its movement from said retracted to said extended position;

a seal between said plug means and said core barrel means;

piston means connected to said core barrel means to move said core barrel means selectively into the formation;

first retaining means on said piston means to retain said piston means stationary until said first retaining means are overcome; and an annular space between said housing and said core barrel comprising opposed bearing surfaces on said housing;

wherein said housing, core barrel means, and said plug means can be moved into the formation in tandem a sufficient depth to isolate said core barrel means from the well fluids; and wherein application of fluid pressure to said piston means creates a net force in said annulus and said net force acts on said housing in a direction toward the formation prior to defeat of said first retaining means.

4. The apparatus of claim 3, further comprising:

a second retaining means on said plug means to selectively hold said plug means to the inside of said core barrel means;

said plug means extending initially beyond said core barrel means at one end thereof;

said core barrel means extending beyond said housing adjacent one end thereof;

said retained plug, said core barrel means, and said housing presenting a generally pointed profile to facilitate their tandem embedment into the formation with said core barrel means in said retracted position.

5. The apparatus of claim 4, wherein said first and second retaining means each comprise at least one shearable element;

whereupon defeating of said shearing elements said core barrel means travels into the formation beyond said plug means which has earlier been lodged in the formation, said net force continuing to act on said housing;

vent means in said core barrel means to allow fluids to escape said core barrel means behind said plug means as said core barrel means is driven past said plug means.

6. The apparatus of claim 5, wherein said core barrel means comprises an elongated tubular member having a core retention means at one end circumscribing said plug means when said core barrel means is in the retracted position;

said core retention means remaining open to allow sample admission as said core barrel means moves toward its extended position;

said core retention means closing as said core barrel means is moved toward its retracted position.

7. The apparatus of claim 6, further comprising:

valve means in said housing, said core barrel means extending through said valve means when said core barrel means is in its retracted position prior to defeat of said first retaining means;

detent means on said core barrel to engage said valve means upon movement of said core barrel means toward its retracted position after sampling;

whereupon as said core barrel means clears said valve means said detent means urges said valve means into a closed position.

8. The apparatus of claim 7, wherein said core barrel means further comprises:

a lower section wherein said plug means and said core retention means are located;

a middle section comprising said piston means;

an upper tubular section housing said vent means;

said vent means communicating into said lower section through said piston and through the wall of said upper section;

a cross-flow block in said upper section, said vent means extending laterally therethrough for access through the wall of said upper section;

said upper section also including a flowpath through said cross-flow block to allow fluid communication through said upper section to said piston means;

said upper section retaining a slip joint for slidable movement with respect to said upper section, said slip joint having a shoulder which can be selectively brought into contact with said upper section to further drive said lower section into the formation if desired.

9. The apparatus of claim 3, further comprising:

force applying means in flow communication with said piston and said annulus to create pressure thereon;

force storage means to store potential energy created by said force applying means and release it when said force applying means overcomes said first retaining means.

10. A core sampling tool comprising:

a housing;

a core barrel releasably mounted to said housing for movement through an entrance thereon between an extended position for sampling and a retracted position;

releasable retention means to selectively hold said core barrel to said housing to facilitate their tandem insertion into a formation to a depth sufficient to exclude well fluids from the core barrel as it is subsequently moved to its extended position;

releasable barrier means to selectively block off said entrance to said core barrel as said housing, core barrel and barrier means are pushed into the formation in tandem prior to movement of said core barrel to its extended position.

11. The apparatus of claim 10, further comprising:

fluid pressure biasing means acting on said housing to apply a net force on said housing tending to keep it in the formation as said core barrel moves from its retracted to its extended position.

12. The apparatus of claim 11, wherein:

said barrier means is a plug sealingly mounted to the inside of said core barrel adjacent its entrance and having a tapered profile at its leading end which extends beyond said core barrel entrance, said housing and core barrel also having a tapered profile adjacent said tapered profile of said plug to facilitate their embedment into a formation.

13. A core sampling tool comprising:

a housing;

a core barrel mounted to said housing for movement through an entrance thereon between an extended position for sampling and a retracted position;

retention means to selectively hold said core barrel to said housing to facilitate their tandem insertion into a formation to a depth sufficient to exclude well fluids from the core barrel as it is subsequently moved to its extended position;

barrier means to selectively block off said entrance to said core barrel as said housing, core barrel and barrier means are pushed into the formation in tandem prior to movement of said core barrel to its extended position; and biasing means acting on said housing to apply a net force on said housing tending to keep it in the formation as said core barrel moves from its retracted to its extended position;

wherein said barrier means is a plug sealingly mounted to the inside of said core barrel adjacent its entrance and having a tapered profile at its leading end which extends beyond said core barrel entrance, said housing and core barrel also having a tapered profile adjacent said tapered profile of said plug to facilitate their embedment into a formation; and wherein said biasing means further comprises:

a piston connected to said core barrel;

a flowpath from the end of said core barrel opposite said plug to said piston;

an annular space between said housing and said core barrel, said flowpath extending into said annular space;

said annular space having a pair of opposed bearing surfaces of unequal cross-sectional area;

whereupon application of fluid pressure in said passage against said piston, a net force is applied to said housing due to pressure in said annular space acting on said bearing surfaces which tends to push said housing into the formation.

14. The apparatus of claim 13, further comprising:

a first retention means on said piston to selectively fix it to said housing;

a second retention means on said plug to selectively fix it to said core barrel;

accumulator means in flow communication with said flowpath to store an applied fluid force so that it can be released as said applied force overcomes said first and second retention means which starts said core barrel moving past said plug which is up against the formation;

sample retention means mounted to said core barrel and held in an open position prior to defeat of said second retention means and until said core barrel reaches its extended position, whereupon reversal of direction of movement of said core barrel results in closing of said sample retention means to hold a sample in the core barrel.

15. The apparatus of claim 14, further comprising:

valve means in said housing, said core barrel extending through said valve means when said piston is held to said housing by said first retention means;

detent means in said core barrel to engage said valve means as said core barrel moves toward its retracted position, after extension, to close said valve means after said core barrel clears said valve means;

vent means to vent portions of said core barrel disposed between said piston and said plug;

said vent means further comprising check valve means in said piston to prevent well fluids from entering said core barrel while allowing venting from said core barrel.

16. The apparatus of claim 13, further comprising:

force applying means in flow communication with said piston and said annulus to create pressure thereon;

force storage means to store potential energy created by said force applying means and release it when said force applying means overcomes said first retention means.

17. A method of obtaining core specimens from a formation, comprising the steps of:

lowering a tool having a housing and a core barrel with its entrance initially plugged off to a point adjacent the formation;

retaining the core barrel to the housing;

driving the assembly of the core barrel, housing, and plug at the entrance to said core barrel into the formation to a sufficient depth to isolate the plugged of entrance to the core barrel from well fluids;

moving the core barrel with respect to said housing and with respect to said plug at its entrance to obtain a sample; and applying a downward force on said housing as said core barrel is moved with respect to said housing and said plug to help retain said housing in the formation a sufficient depth to isolate the core barrel from well fluids.

18. The method of claim 17, further comprising the steps of:

applying a force on a piston connected to said core barrel;

allowing the force to build up on said piston while it is retained to the housing which at the same time results in application of force to the housing to retain it in the formation;

overcoming a restraint on the plug at the entrance of the core barrel; and driving the core barrel past the piston.

19. The method of claim 18, further comprising the step of:

using an accumulator to multiply the duration of the force applied to accelerate the piston.

* * * * *